US007134783B2

(12) United States Patent
Schmiedchen et al.

(10) Patent No.: US 7,134,783 B2
(45) Date of Patent: Nov. 14, 2006

(54) DEVICE FOR ADJUSTING A TIME INDICATOR

(75) Inventors: Christian Schmiedchen, Reichstädt (DE); Mathias Schneider, Heidenau (DE); Patrick Streubel, Heidenau (DE)

(73) Assignee: Glashütter Uhrenbetrieb GmbH, Glashütte/Sachsen (DE)

( * ) Notice: Subject to any disclaimer, the term of this patent is extended or adjusted under 35 U.S.C. 154(b) by 258 days.

(21) Appl. No.: 10/472,470

(22) PCT Filed: Mar. 21, 2001

(86) PCT No.: PCT/EP01/03435

§ 371 (c)(1),
(2), (4) Date: Sep. 22, 2003

(87) PCT Pub. No.: WO02/077721

PCT Pub. Date: Oct. 3, 2002

(65) Prior Publication Data

US 2004/0095850 A1 May 20, 2004

(51) Int. Cl.
*G04B 19/24* (2006.01)
*G04B 27/02* (2006.01)

(52) U.S. Cl. ..... 368/190; 368/31; 368/34

(58) Field of Classification Search ..... 368/76, 368/139, 157, 160, 190–195, 35–37, 319–322, 368/31, 34

See application file for complete search history.

(56) References Cited

U.S. PATENT DOCUMENTS 3,439,493 A * 4/1969 Gruner et al. ..... 368/35
3,820,318 A * 6/1974 Fluck ..... 368/35
5,077,708 A * 12/1991 Schneider ..... 368/107
5,119,349 A * 6/1992 Muto et al. ..... 368/157
5,384,755 A * 1/1995 Ferenczy ..... 368/35
2004/0246820 A1* 12/2004 Girardin ..... 368/76

FOREIGN PATENT DOCUMENTS

| | | |
|---|---|---|
| CH | 2 247/72 | 2/1975 |
| FR | 2 283 477 | 3/1976 |
| FR | 2 444 963 | 7/1980 |

OTHER PUBLICATIONS

International Search report completed Aug. 8, 2001 and mailed Aug. 22, 2001 in PCT/EP 01/03435.

* cited by examiner

*Primary Examiner*—Kammie Cuneo
*Assistant Examiner*—Jeanne-Marguerite Goodwin
(74) *Attorney, Agent, or Firm*—Griffin & Szipl, P.C.

(57) ABSTRACT

The device for adjusting a time indicator includes a gear train (1), the kinematic chain of which includes a sliding pinion (2) driven by a driving wheel set (3). The sliding pinion drives a driven wheel set (4) when the driving wheel set rotates in a first direction (A) and disconnects from said driven wheel set when said driving wheel set (3) rotates in a second direction (B), opposite to the first direction. The shaft (6) that the sliding pinion (2) includes is engaged in a groove (7) having first (9) and second (12) end portions, at least the first end portion (9) of which is directed radially (R) to the driven wheel set (4).

9 Claims, 5 Drawing Sheets

DEVICE FOR ADJUSTING A TIME INDICATOR

This is a National Phase Application in the U.S. of International Patent Application No. PCT/EP01/03435 filed Mar. 21, 2001. The entire disclosure of the above patent application is hereby incorporated by reference.

FIELD OF THE INVENTION

The present invention relates to a device for adjusting a time indicator including a gear train, the kinematic chain of which includes a sliding pinion driven by a driving wheel set, said sliding pinion driving a driven wheel set when the driven wheel set rotates in a first direction and disconnecting from said driven wheel set when said driving mobile rotates in a second direction, opposite to the first direction, to interrupt said kinematic chain.

BACKGROUND OF THE INVENTION

Such a device is known. It is fitted, for example, to a watch displaying both the date and the day of the week. In this watch, the date and day of the week are set by means of a stem capped by a crown. When the stem is pulled into a first position and the crown is rotated in a first direction, the date is corrected. From this same pulled out position, the day of the week is corrected by rotating the crown in a second direction, opposite to the first. These functions are obtained by means of a sliding pinion meshing with the stem and driving either the date-ring, or the day-disc depending on the rotational direction of the crown.

If the device described hereinbefore gives entire satisfaction for the stated functions, it has a major drawback if it is implemented in a watch comprising for example a date and a timer, the latter allowing the countdown and display on a dial of a predetermined time interval. Indeed, when passing from the calendar date-setting to the desired time-setting of the timer, or vice-versa, the time displayed by the timer is upset or disturbed, this disturbance being caused by the sliding pinion which is not introduced or is removed from the wheel set that it drives along an appropriate direction.

SUMMARY OF THE INVENTION

In order to overcome this drawback, the device of the invention, in addition to satisfying the description of the first paragraph hereinbefore, is original and characterized in that the shaft that the sliding pinion includes is engaged in a groove having first and second final portions, at least the first final portion of the groove being directed radially to the wheel set driven by the sliding pinion.

BRIEF DESCRIPTION OF THE DRAWINGS

The invention will now be explained in more detail hereinafter via an embodiment given by way of example, this embodiment being illustrated by the annexed drawings, in which.

DETAILED DESCRIPTION OF THE INVENTION

Figure 1:
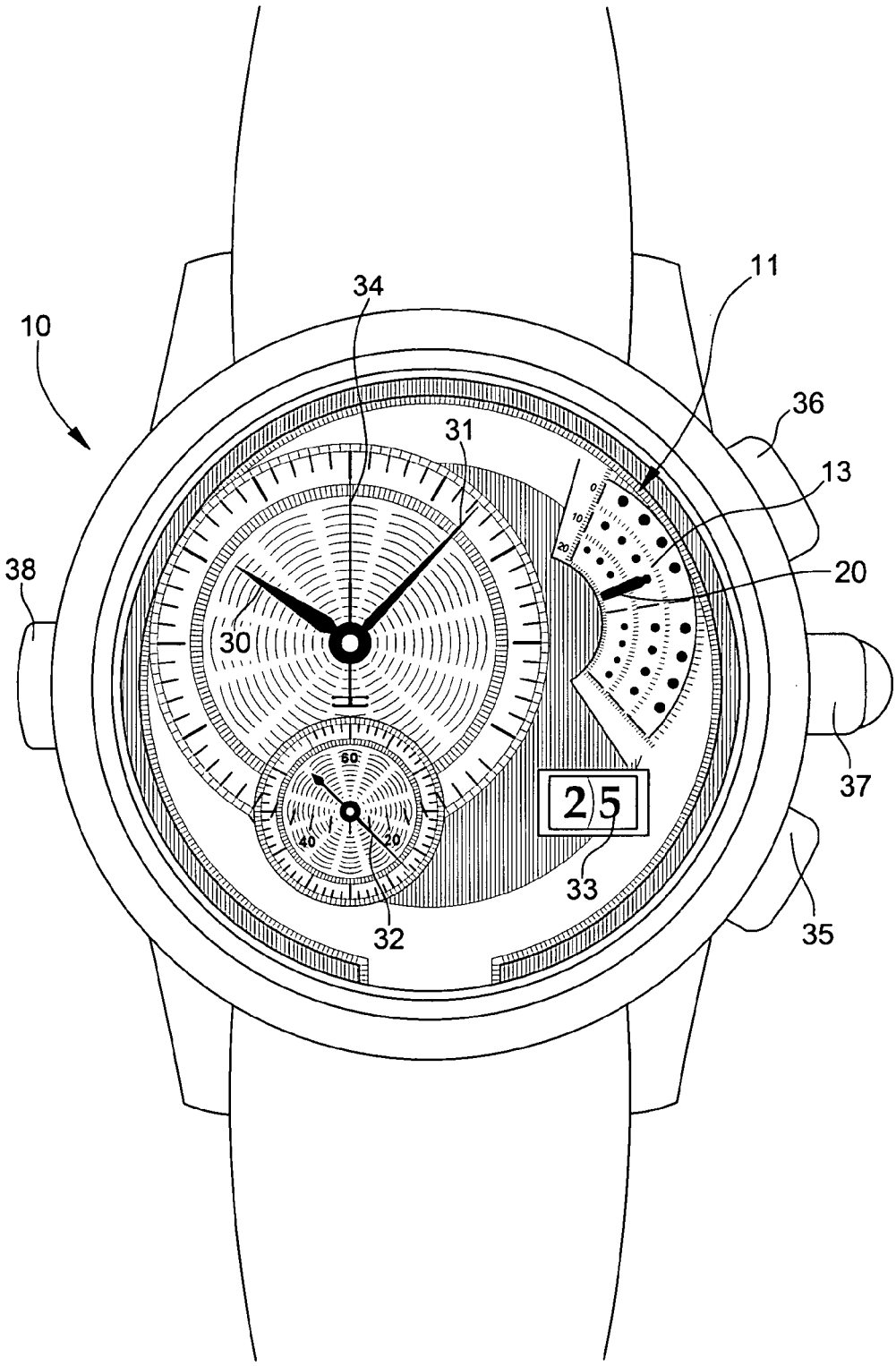
FIG. 1 is a plan view of the timepiece containing the invention.

FIG. 1 is a plan view of the timepiece 10 containing the invention. This timepiece includes time-keeping hands, namely an hour hand 30, a minute hand 31 and a small second hand 32. A large date aperture 33 completes the timekeeper. The timepiece taken as an example here also includes a chronograph function with a second hand 34 and a minute counter 11. Hand 34 and counter 11 are started and stopped by means of a first push-button 35, whereas a second push-button 36 allows indicators 34 and 11 to be reset to zero. A crown 37 allows the timepiece to be wound, the calendar to be updated and the hands of the timekeeper to be set, depending upon the axial positions into which it is brought.

In the timepiece taken by way of example here, minute counter 11 is also used as a timer or countdown device 11, the setting of the time period to be counted down being entrusted to crown 37. The timer is started and the striking-work barrel that activates a striking-work indicating the end of the countdown is wound by pressing on a third push-button 38. As is shown by all the annexed Figures, counter-timer 11 includes a dial 13 containing three concentric scales each of ten minutes and over each of which a hand of different width 19, 20 and 21 travels.

Figure 2:
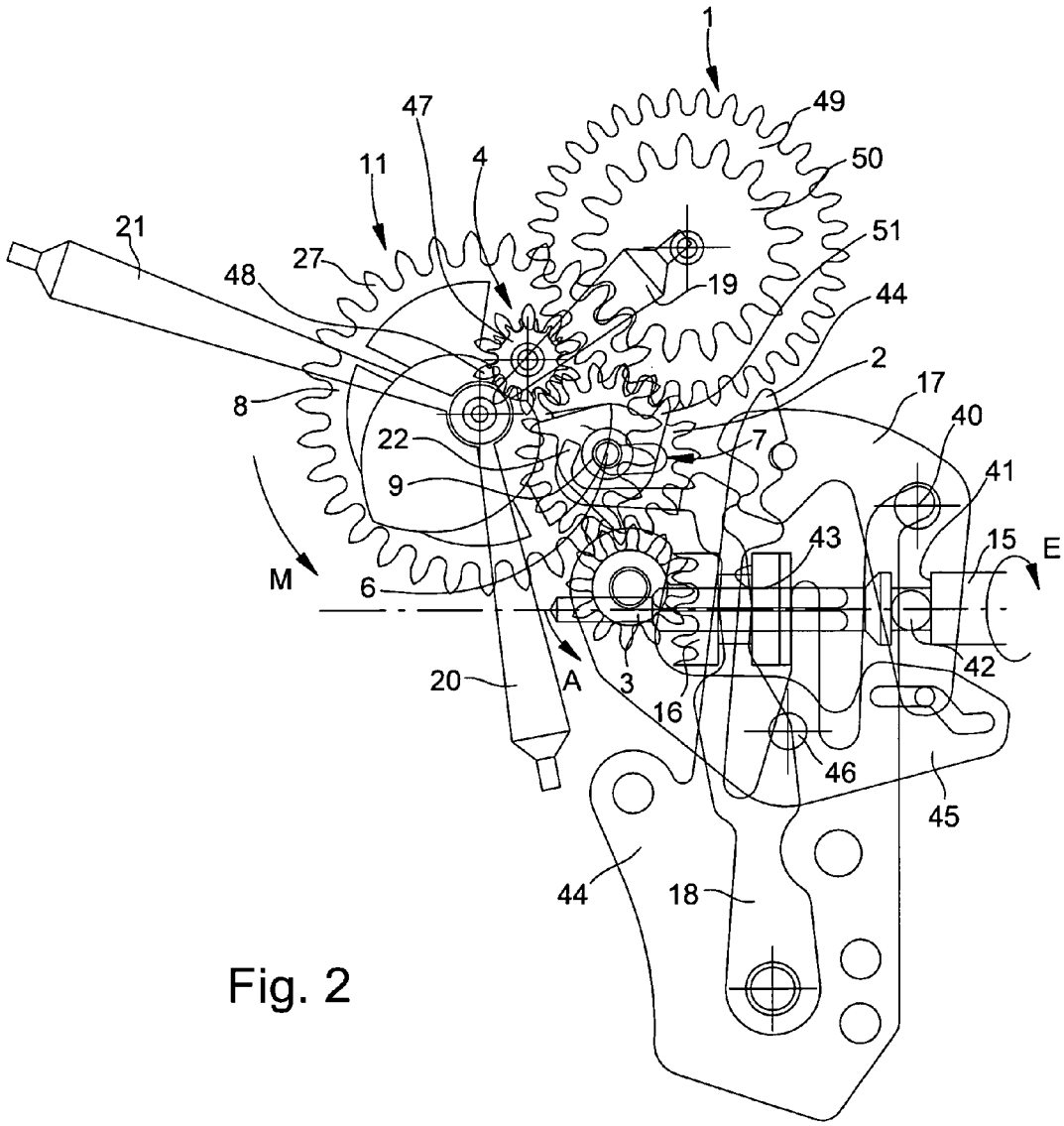
FIG. 2 is a plan view of the adjustment device according to the invention, this device showing a sliding pinion meshed in a kinematic chain.
Figure 3:
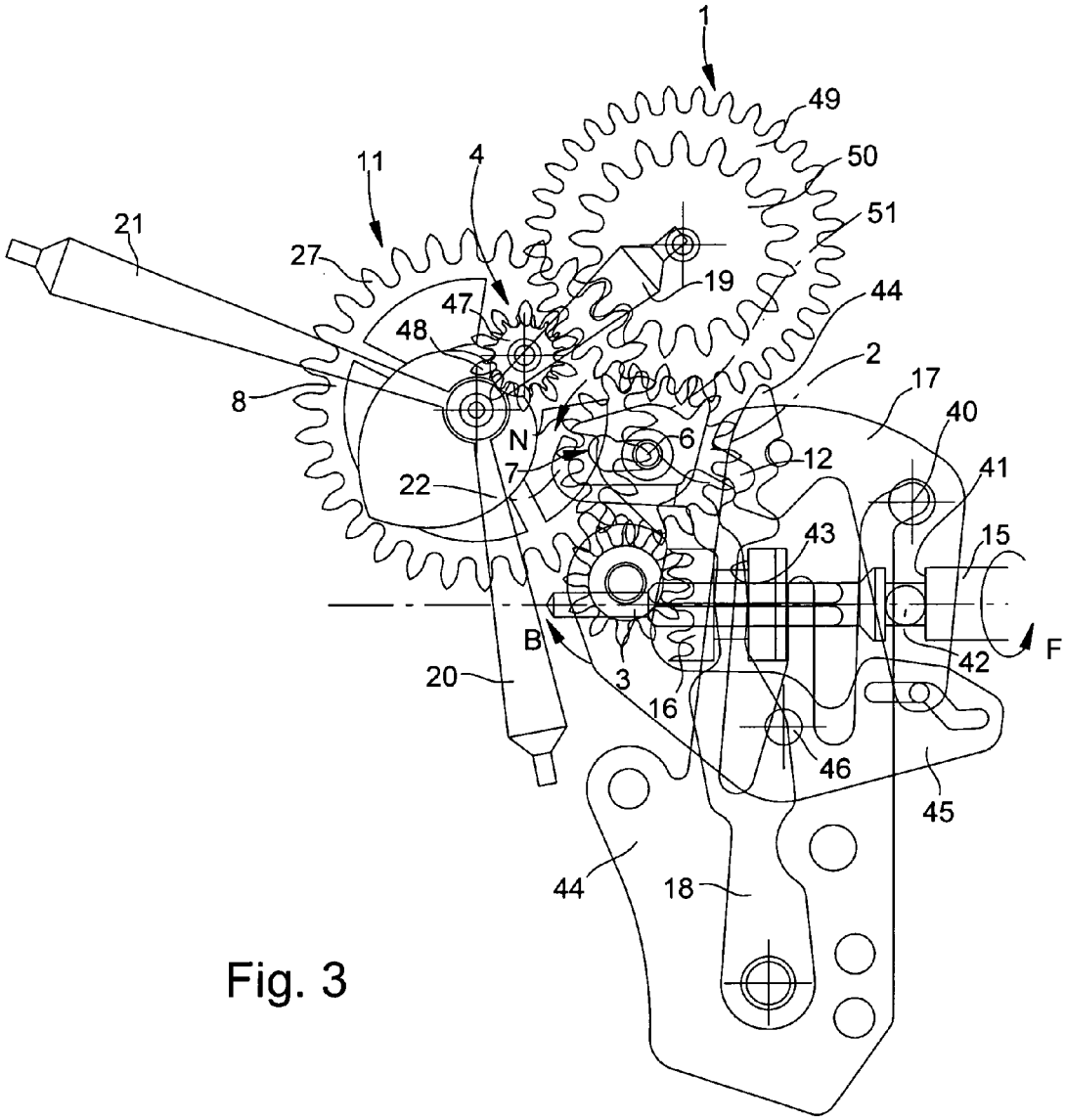
FIG. 3 is a plan view of the adjustment device according to the invention, this device showing a sliding pinion disconnected from a kinematic chain.

As FIGS. 2 to 5 show, the device for adjusting a time indicator—here timer 11—includes a gear train 1 whose kinematic chain includes a sliding pinion 2 driven by a driving wheel set 3. The sliding pinion drives a driven wheel set 4 when driving wheel set 3 rotates in a first direction A. This situation is shown in FIG. 2. Conversely, FIG. 3 shows that when driving wheel set 3 rotates in a second direction B, opposite to the first, sliding pinion 2 is disconnected from driven wheel set 4. The kinematic chain is then interrupted.

In order to understand the invention properly, reference will now be made to FIG. 4. It can clearly be seen here that sliding pinion 2 includes a shaft 6 engaged in a groove 7 made for example in the plate or in a bridge of the timepiece. This groove 7 has first and second final portions 9 and 12, the invention residing in the fact that at least a first final portion 9 of groove 7 is directed radially (reference R) to driven wheel set 4.

Figure 4:
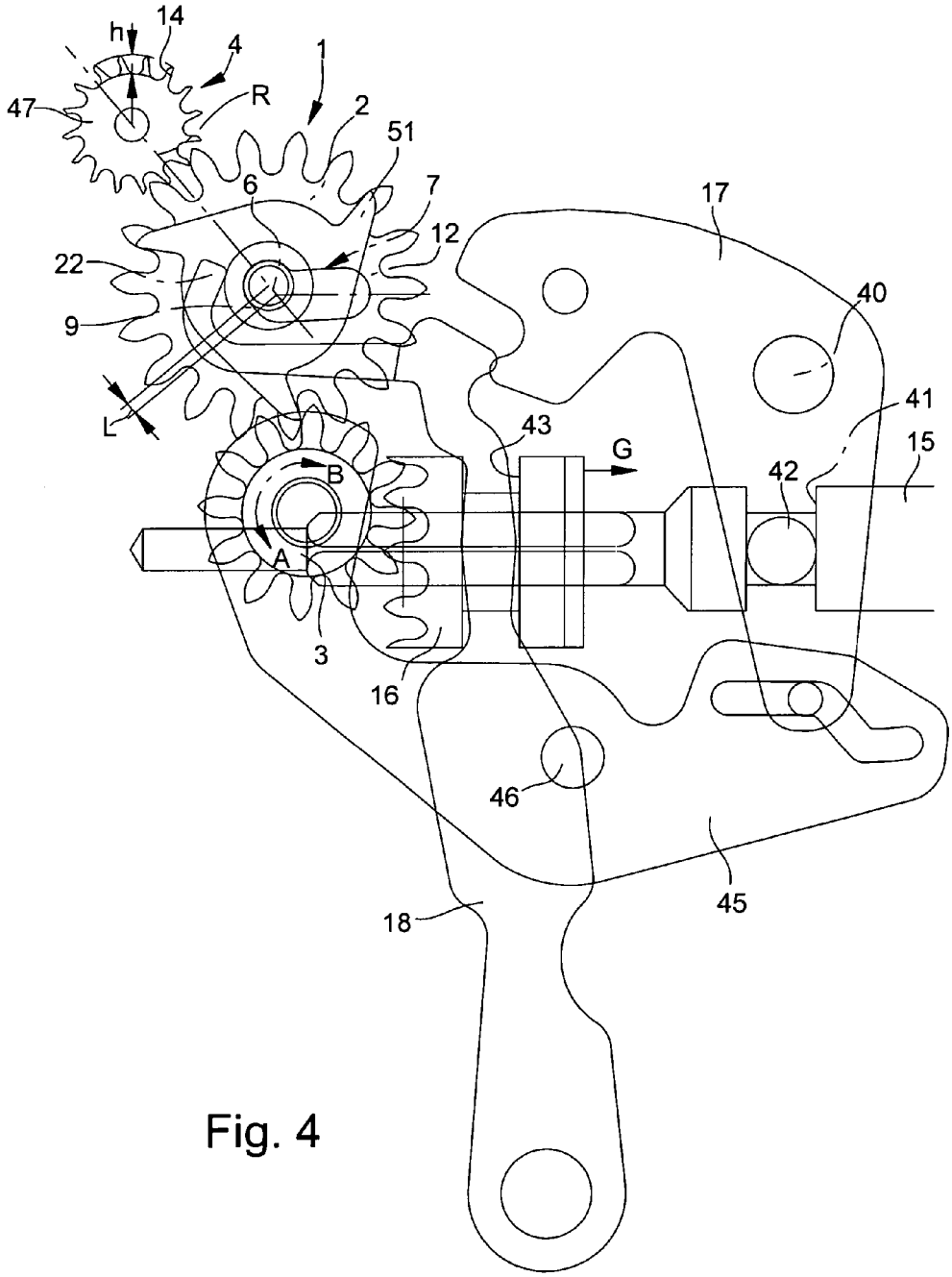
FIG. 4 is an enlargement of FIG. 2 in which only the elements actually required to understand the invention have been kept.

FIG. 4 clearly shows that when sliding pinion 2 is engaged or released from driven wheel set 4, it is obliged to follow the first portion 9 of groove 7, this portion being directed towards the centre of driven wheel set 4. Thus, on leaving toothing 14 of driven wheel set 4, sliding pinion 2 does not change the angular position of said driven wheel set at all and thus in no way disturbs the value of the time entered in timer 11 which is at the end of the kinematic chain.

Examination of FIG. 4 also demonstrates that the width of the first final portion 9 of groove 7 or, in other words, the length L of the path travelled by shaft 6 of sliding pinion 2 in said first final portion 9 has to be substantially larger than the height h of teeth 14 of driven wheel set 4, in order to allow the sliding pinion to be completely released from said driven wheel set.

It was already mentioned hereinbefore that the time indicator considered here is a timer 11 allowing the countdown and display on a dial 13 of a predetermined time interval. The Figures show that the device for adjusting this timer includes a stem 15 capped by a crown 37 able to be actuated manually, an assembly formed by a sliding pinion 16, a pull-out piece 7 and a lever 18 connected to stem 15, and a gear train 1 ending with said timer formed by minute wheel 8. Gear train 1 can be driven by sliding pinion 16 when stem 15 is pulled out in a determined axial position (in this example: the first pulled out position).

FIGS. 2 and 3 show the mechanism connected to stem 15. There one finds, in a conventional manner, the pull-out piece 17, which pivots at 40. The first end of the pull-out piece is engaged by a pin 42 in a groove 41 of stem 15. The second end of the pull-out piece controls lever-18, which is itself engaged in a groove 43 of sliding pinion 16. The position of pull-out piece 17 is ensured by a jumper-spring 44. The mechanism is completed by a second lever 45, which is controlled by pull-out piece 17, and pivots at 46, this second lever 45 carrying driving wheel set 3.

Figure 5:
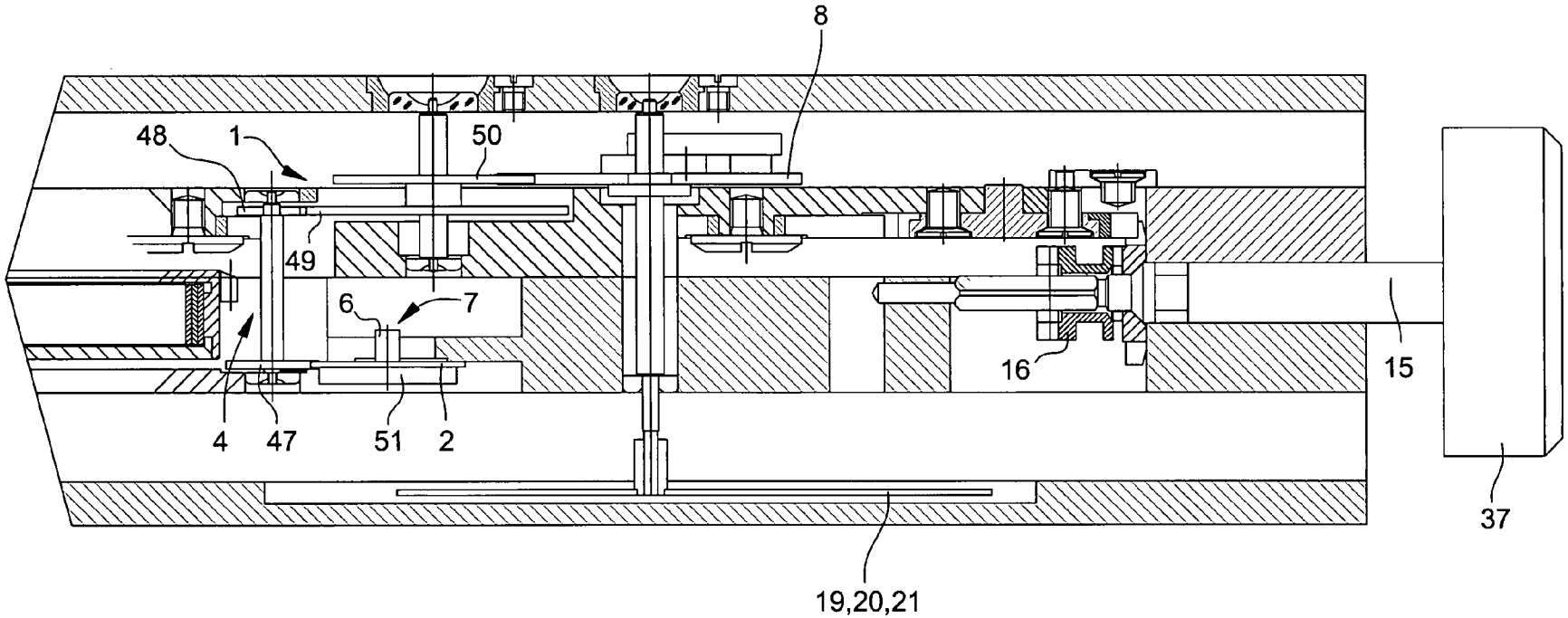
FIG. 5 is a cross-section of the adjustment device according to the invention.

The same FIGS. 2 and 3 and the cross-section of FIG. 5 show which elements form gear train 1. Sliding pinion 16 drives driving pinion 3 that in turn drives sliding pinion 2. When the stem rotates in direction E (see FIG. 2), sliding pinion 2 drives driven wheel set 4, which is formed, as can be seen in FIG. 5, of two wheels 47 and 48 mounted coaxially and secured to each other. Wheel 48 meshes with a wheel 49 mounted coaxial and secured to a wheel 50, which drives finally minute wheel 8 forming timer 11.

It was seen hereinbefore that driven wheel set 4 includes a wheel 47 meshing with sliding pinion 2 (see particularly FIG. 4). In the timepiece taken as an example here, it can be seen that a single distance between teeth of sliding pinion 2 embraces two teeth 14 of wheel 47 and that the teeth 14 of wheel 47 have a particular profile. This arrangement allows the gentle introduction of sliding pinion 2 into wheel 47. It will also be understood that this particular profile prevents teeth 14 butting on the toothing of sliding pinion 2 when the latter penetrates wheel 47.

The description of the adjustment device given hereinbefore now allows the operation of said device to be explained.

When stem 15 is pulled out into a determined axial position (here the first pulled out position) and crown 37 is rotated in a first direction (namely direction E or anticlockwise as is shown in FIG. 2), sliding pinion 2 is meshed with driven wheel set 4 and more precisely wheel 47 of said wheel set 4. Shaft 6 of sliding pinion 2 is positioned at the bottom of first portion 9 of groove 7 into which it is moved. From this moment, and if crown 37 continues to be rotated in the same direction E, minute hand 8 of timer 11 is driven in the direction of arrow M which enables the desired time interval to be selected. Once this time interval has been chosen, push-button 38 is pressed (see FIG. 1) to simultaneously wind a barrel which will cause an alarm to ring at the end of the countdown.

It will be noted here that the mechanism shown in FIG. 2 is seen from underneath the timepiece, which explains that the direction of arrow M is the reverse of the countdown direction shown in FIG. 1 where the timepiece is seen from above.

When stem 15 is pulled-out into the same axial position as that established hereinbefore and crown 37 is rotated in a second direction (namely direction F or anticlockwise as shown in FIG. 3), sliding pinion 2 is disconnected from driven wheel set 4 and more precisely from wheel 47 thereof. Shaft 6 of sliding pinion 2 is the positioned at the bottom of second portion 12 of groove 7 into which it is moved. From this moment, and if crown 37 continues to be rotated in the same direction F, sliding pinion 2 is driven in the direction of arrow N, which enables a calendar 33 to be set (see FIG. 1). For this purpose, sliding pinion 2 carries a star-wheel (see also FIG. 5). This star-wheel is meshed with a calendar mechanism (not shown here).

FIGS. 2, 3 and 4 show that lever 18 carries or is extended by a hook 22. This hook is capable of quickly driving shaft 6 of sliding pinion 2 to the bottom of second end portion 12 of groove 7. Indeed, when stem 15 is pushed into a position allowing the timepiece to be rewound, sliding pinion 16 moves in the direction of arrow G shown in FIG. 4, which drives lever 18 and hook 22 in the same direction. Hook 22 abuts shaft 6 and quickly drives the shaft and sliding pinion 2 that is connected thereto along first portion 9 then along second portion 12 of groove 7. Sliding pinion 2 is thus quickly released from driven wheel 47, which thus prevents any disturbance of the timer gear chain, such disturbance being able to occur because the sliding pinion is left free.

The invention claimed is:

1. A device for adjusting a time indicator of a timepiece including a gear train, a kinematic chain of which includes a sliding pinion driven by a driving wheel set, the sliding pinion driving a driven wheel set when the driving wheel set rotates in a first direction and disconnecting from the driven wheel set when the driving wheel set rotates in a second direction, opposite to the first direction, to interrupt said kinematic chain, wherein a shaft that the sliding pinion includes is engaged in a groove having first and second end portions, at least the first end portion of said groove being directed radially to the driven wheel set wherein the at least first end portion is arranged on a side of the driven wheel set, wherein the sliding pinion follows a path extending radially with respect to a center of the driven wheel set when the sliding pinion engages with, and respectively disengages from, the driven wheel set, so engaging and disengaging movement of the driving wheel set occurs without changing angular position of the driven wheel set.

2. A device according to claim 1, wherein the length of said first end portion is substantially greater than the height of the teeth of said driven wheel set.

3. A device according to claim 1, wherein the time indicator is a timer for counting down and displaying on a dial a predetermined time interval, said adjustment device including a stem capped by a crown able to be activated manually and an assembly formed of the sliding pinion, a pull-out piece and a lever connected to said stem, the gear train being capable of being driven by the sliding pinion when the stem is pulled out in a determined axial position, said gear train in turn driving a minute wheel forming said timer.

4. A device according to claim 3, wherein when the stem is pulled out into said determined axial position and the crown is rotated in a first direction, the sliding pinion is meshed with the driven wheel set, the shaft of the sliding pinion then being positioned at the bottom of the first end portion of the groove into which the shaft is moved, the crown continuing to rotate in said first direction thus allowing display of the selected time interval on the dial.

5. A device according to claim 3, wherein when the stem is pulled out into said determined axial position and the crown is rotated in a second direction, the sliding pinion is disconnected from the driven wheel set, the shaft of the sliding pinion then being positioned at the bottom of the second end portion of the groove into which the shaft is moved, the crown continuing to rotate in said second direction, thus allowing a date mechanism fitted to the timepiece to be set.

6. A device according to claim 3, wherein the lever carries a hook capable of quickly driving the shaft of the sliding pinion to the bottom of the second end portion of the groove when the stem is pushed into a position allowing the timepiece to be rewound.

7. A device for adjusting a time indicator of a timepiece including:

a gear train comprising a kinematic chain that includes a sliding pinion driven by a driving wheel set , wherein the sliding pinion is disposed to drive a driven wheel set when the driving wheel set rotates in a first direction and to disconnect from the driven wheel set when the driving wheel set rotates in a second direction, opposite to the first direction, to interrupt the kinematic chain, wherein the sliding pinion includes a shaft engaged in a groove made in the timepiece and having first and second end portions, at least the first end portion of the groove is directed radially to the driven wheel set, and when the sliding pinion is engaged or released from the driven wheel set, the sliding pin follows the first end portion of the groove and the sliding pinion does not change angular position of the driven wheel set, and wherein a timer is arranged at an end of the kinematic chain and a value of time entered in the timer is not disturbed when the sliding pinion is engaged or released from the driven wheel set.

8. A device according to claim 7, wherein the kinematic train includes the sliding pinion, the driving wheel set and the driven wheel set.

9. A device for adjusting a time indicator of a timepiece including a gear train, a kinematic chain of which includes a sliding pinion driven by a driving wheel set, the sliding pinion driving a driven wheel set when the driving wheel set rotates in a first direction and disconnecting from the driven wheel set when the driving wheel set rotates in a second direction, opposite to the first direction, to interrupt said kinematic chain, wherein a shaft that the sliding pinion includes is engaged in a groove having first and second end portions, at least the first end portion of the groove being directed radially to the driven wheel set, wherein the driving wheel set has a first center of rotation, the driven wheel set has a second center of rotation and the first end portion of the groove is arranged parallel to a line connecting the first center of rotation and the second center of rotation.

* * * * *